US010654095B2

(12) United States Patent
Cobzaru

(10) Patent No.: US 10,654,095 B2
(45) **Date of Patent: *May 19, 2020**

(54) SWIVEL ADJUSTMENT SYSTEM FOR FASTENER PULLING HEADS

(71) Applicant: SPS TECHNOLOGIES, LLC, Jenkintown, PA (US)

(72) Inventor: Cristinel Cobzaru, Murrieta, CA (US)

(73) Assignee: SPS TECHNOLOGIES, LLC, Jenkintown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/146,666

(22) Filed: Sep. 28, 2018

(65) Prior Publication Data

US 2019/0030589 A1 Jan. 31, 2019

Related U.S. Application Data

(63) Continuation of application No. 14/701,026, filed on Apr. 30, 2015, now Pat. No. 10,112,233.

(51) Int. Cl.

| | |
|---|---|
| ***B23Q 3/08*** | (2006.01) |
| ***B21J 15/38*** | (2006.01) |
| ***B21J 15/02*** | (2006.01) |
| ***B21J 15/04*** | (2006.01) |
| ***B21J 15/10*** | (2006.01) |

(52) U.S. Cl.

CPC ..... *B21J 15/383* (2013.01); *B21J 15/022* (2013.01); *B21J 15/043* (2013.01); *B21J 15/105* (2013.01)

(58) Field of Classification Search

CPC ..... B23P 11/00; B23P 11/005; B23P 19/00; B23P 19/04; B23Q 3/00; B21J 15/00

See application file for complete search history.

(56) References Cited

U.S. PATENT DOCUMENTS

| | | | | |
|---|---|---|---|---|
| 5,604,967 | A * | 2/1997 | McMahon | B25B 27/023 29/263 |
| 6,266,859 | B1 * | 7/2001 | Hernandez | B25B 27/023 29/256 |
| 6,648,317 | B2 * | 11/2003 | Takahashi | B25B 5/087 269/228 |
| 10,112,233 | B2 * | 10/2018 | Cobzaru | B21J 15/022 |
| 2016/0318094 | A1 * | 11/2016 | Cobzaru | B21J 15/022 |

* cited by examiner

*Primary Examiner* — Lee D Wilson

(74) *Attorney, Agent, or Firm* — Burris Law, PLLC

(57) ABSTRACT

An adjustment system for a fastener pulling head includes a swivel adapter, an adjustment member, and a retention member. The fastener pulling head includes a frame, a jaw, and a drawbolt body, the adjustment system. The swivel adapter is configured to engage with a proximal end portion of the drawbolt body. The swivel adapter defines an internal bore. The adjustment member is disposed within the internal bore and configured to engage the drawbolt body. The retention member is configured to engage and secure the swivel adapter at a location within the drawbolt body. When the retention member is disengaged from the swivel adapter, the pulling head can be rotated to cause the frame to move relative to the drawbolt body to adjust a gripping force of the jaw.

20 Claims, 11 Drawing Sheets

SWIVEL ADJUSTMENT SYSTEM FOR FASTENER PULLING HEADS

CROSS-REFERENCE TO RELATED APPLICATIONS

This application is a continuation of application Ser. No. 14/701,026, filed on Apr. 30, 2015. The disclosure of the above application is incorporated herein by reference.

FIELD

The present disclosure relates to pulling heads for the installation of blind fasteners, and more particularly to systems for adjusting the jaw grip force and position of the pulling heads

BACKGROUND

The statements in this section merely provide background information related to the present disclosure and may not constitute prior art.

Blind fasteners are used in a variety of applications and particularly in aircraft manufacturing. Many different types and sizes of blind fasteners are employed in the assembly of aircraft, which are based on the materials/structures being joined and the required strength. Blind fasteners typically include of a sleeve and a stem, along with of locking mechanism if the fastener is permanent (versus temporary such as a tacking fastener). For a typical installation, the stem of the fastener is gripped by jaws inside of a pulling head, while the sleeve of the fastener is biased against an opposite side of the workpieces being joined. More specifically, the stem includes a series of annular grooves, called serrations, which are engaged by the jaws of the pulling head. As the stem is pulled away from the workpieces by the pulling head, deformation of the sleeve occurs on the blind side of the workpieces (or inside of the hole, depending on the particular type of fastener) and eventually the stem fractures, leaving a portion of the stem and a deformed sleeve securing the workpieces together. Additionally, a locking ring is installed, which locks the fastener in an installed position.

Pulling heads are generally comprised of a draw-bolt system that contains a set of jaws to grip the blind fastener and pull its stem. In aerospace blind fastening systems, the gripping force provided by the jaws is important for proper fastener installation. If the force is too low, slippage of the fastener occurs and leads to installation failures, while too much force causes difficulty in using the pulling head, which leads to productivity and tool wear issues.

Additionally, multiple types of pulling heads are provided depending on the application and access limitations. For example, there exist straight, offset, and right-angle pulling heads, which have limited adjustment capability, both in terms of the jaw gripping force and the rotational position of the pulling head relative to the workpieces.

SUMMARY

In one form, an adjustment system for a fastener pulling head is provided that comprises a swivel adapter configured for engagement with a proximal end portion of a drawbolt body of the pulling head, the swivel adapter defining an internal bore. A cap screw is disposed within the internal bore of the swivel adapter and is configured to threadably engage the drawbolt body, and a set screw is configured to engage and secure the swivel adapter within the drawbolt body. When the set screw is disengaged from the swivel adapter, the pulling head can be rotated, which causes the frame to move relative to the drawbolt body within the pulling head to adjust a jaw gripping force.

In another form, a fastener pulling head is provided that comprises a frame, a drawbolt assembly disposed within the frame, the drawbolt assembly comprising a drawbolt body, a jaw slidably engaged with the drawbolt assembly, and an adjustment system for adjusting a gripping force of the jaw and a position of the pulling head. The adjustment system comprises a swivel adapter configured for engagement with a proximal end portion of the drawbolt body, the swivel adapter defining an internal bore. A cap screw is disposed within the internal bore of the swivel adapter and is configured to threadably engage the drawbolt body, and a set screw is configured to engage and secure the swivel adapter within the drawbolt body. When the set screw is disengaged from the swivel adapter, the pulling head can be rotated, which causes the frame to move relative to the drawbolt body within the pulling head to adjust the jaw gripping force.

In still another form, an adjustment system for a fastener pulling head is provided that comprises a swivel adapter configured for engagement with a proximal end portion of a drawbolt body of the pulling head, the swivel adapter defining an internal bore. An adjustment member is disposed within the internal bore of the swivel adapter and is configured to engage the drawbolt body, and a retention member configured to engage and secure the swivel adapter within the drawbolt body. When the retention member is disengaged from the swivel adapter, the pulling head can be rotated, which causes the frame to move relative to the drawbolt body within the pulling head to adjust a jaw gripping force.

In a method according to the present disclosure, a jaw gripping force and position of a fastener pulling head are adjusted by providing a power tool having a piston and a pulling head, engaging a retention member of the pulling head to install the pulling head to the power tool, installing the pulling head onto the piston of the power tool, disengaging the retention member, unlocking a jam nut to allow rotation of the pulling head, rotating the pulling head to a desired position, thereby causing an adjustment system to move a frame relative to a drawbolt assembly disposed within the pulling head, and tightening the jam nut upon reaching the desired position.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 8A:
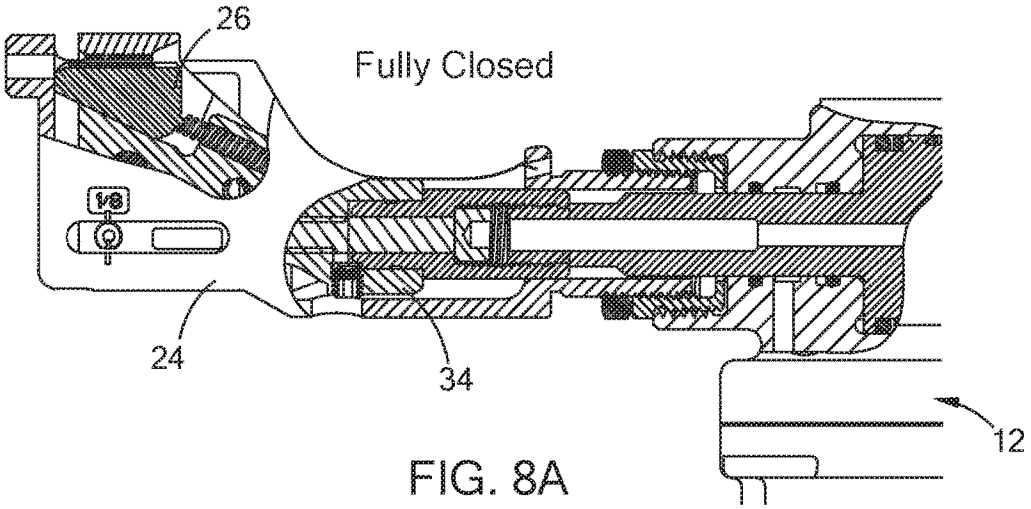
Figure 8B:
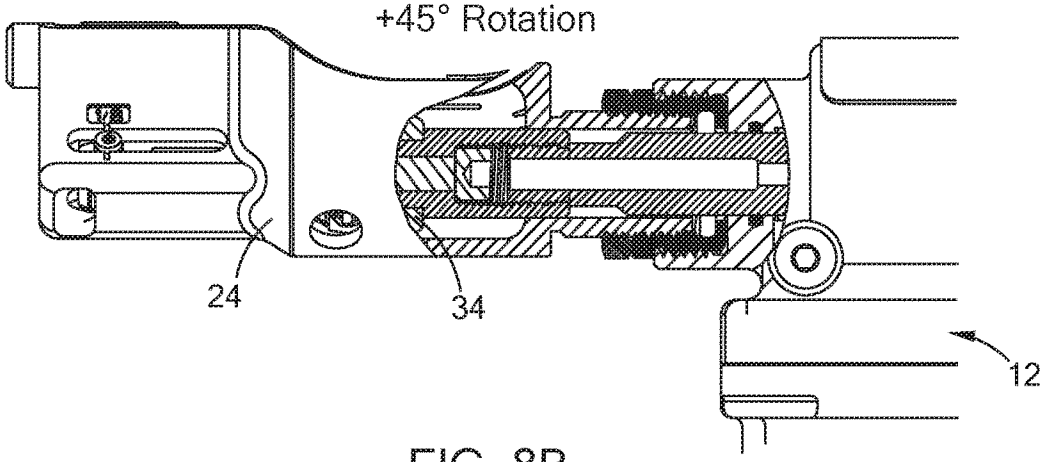
Figure 8C:
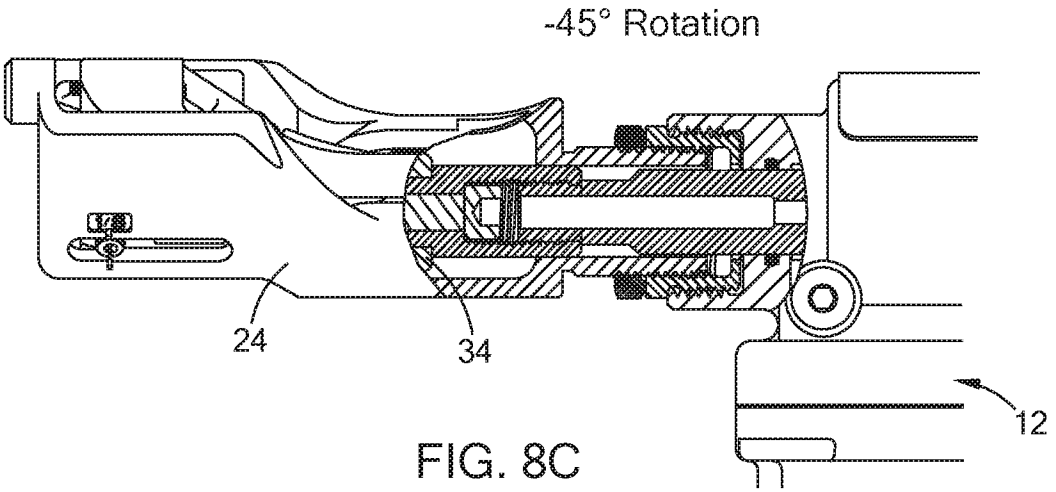
Figure 8D:
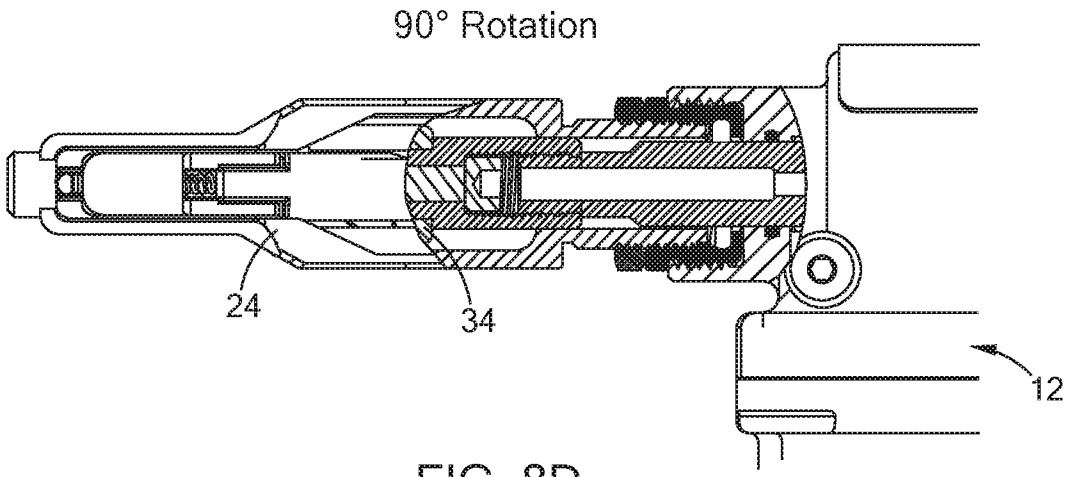
Figure 8E:
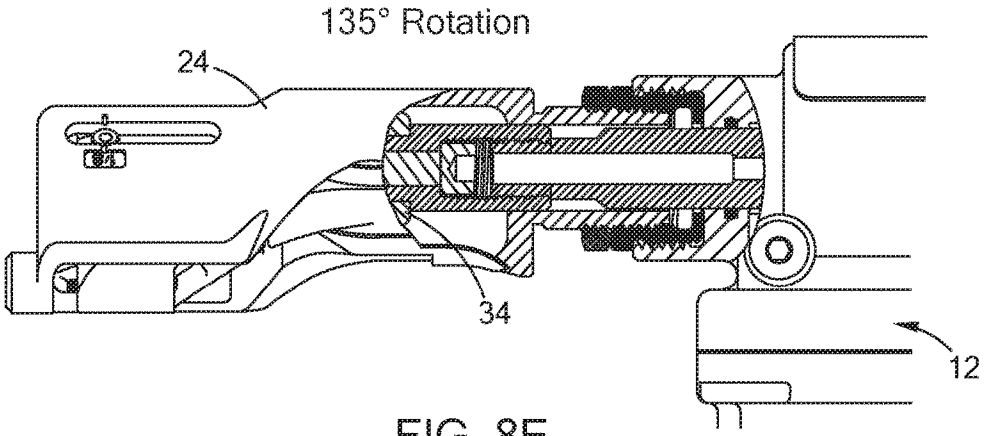
Figure 8F:
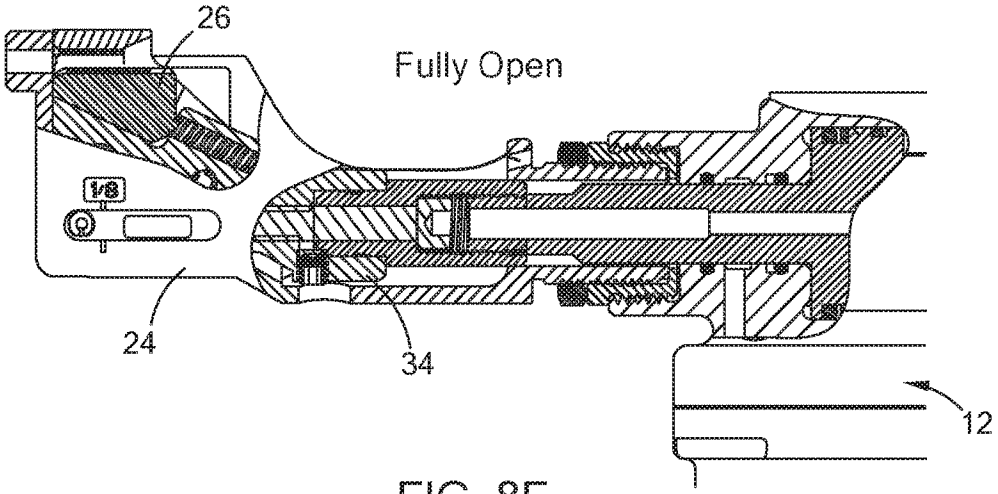
Figure 9:
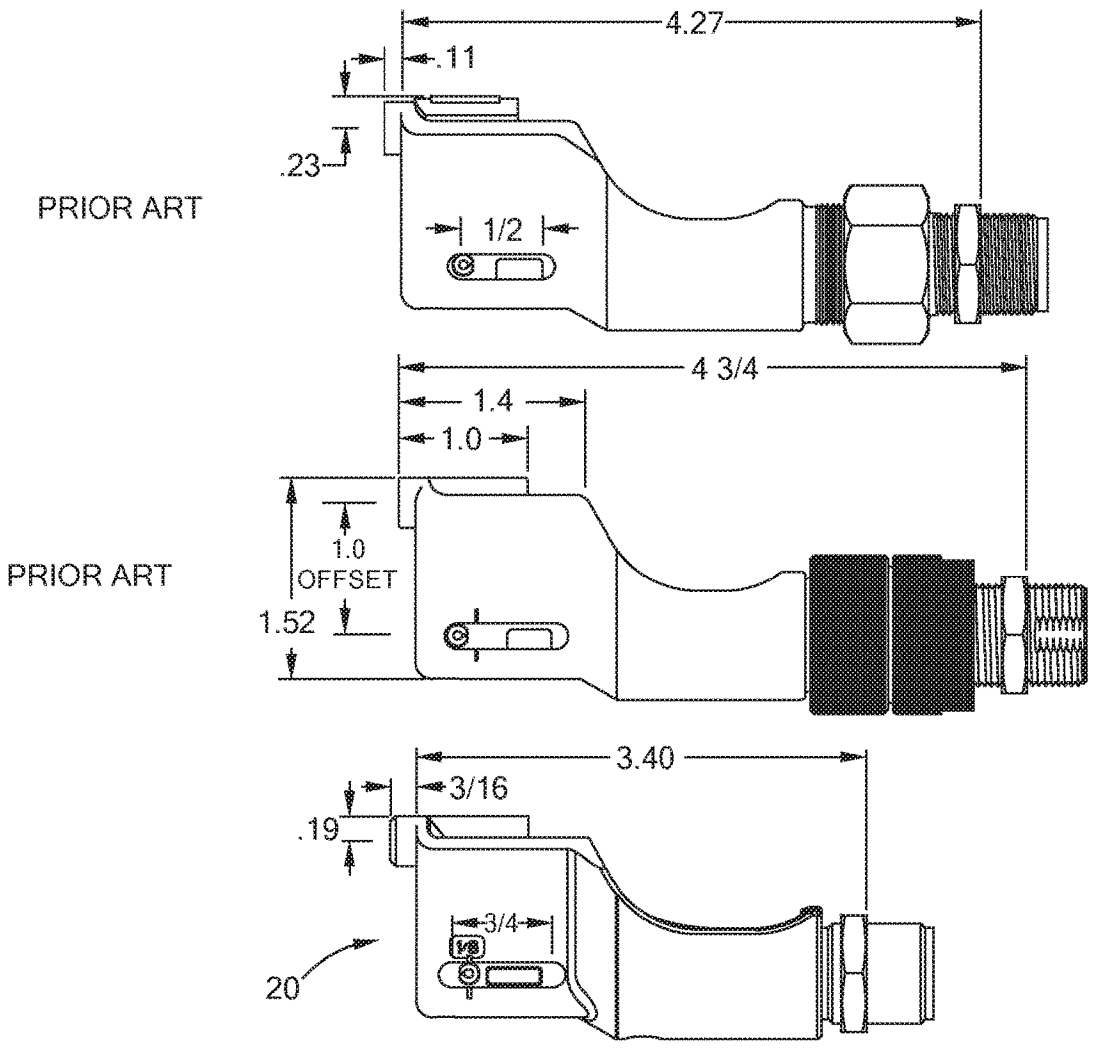

FIGS. 8A through 8F illustrate various rotational positions of the pulling head 20 and the resulting jaw position and engagement with the piston 10 of the power tool 12 according to the teachings of the present disclosure; and FIG. 9 is a size view illustrating a pulling head and its adjustment system according to the teachings of the present disclosure having a compact size compared with pulling heads of the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Fastener pulling heads, their associated power tools, and general operation are described in greater detail, for example, in U.S. Pat. No. 8,615,860, which is commonly assigned with the present application and the contents of which are incorporated herein by reference in their entirety. For purposes of clarity, these prior art pulling heads will not be described in detail herein and thus it should be understood that the adjustment system and fastener pulling head according to the teachings of the present invention, and their various forms, have applicability to such prior art fastener pulling heads.

Figure 1:
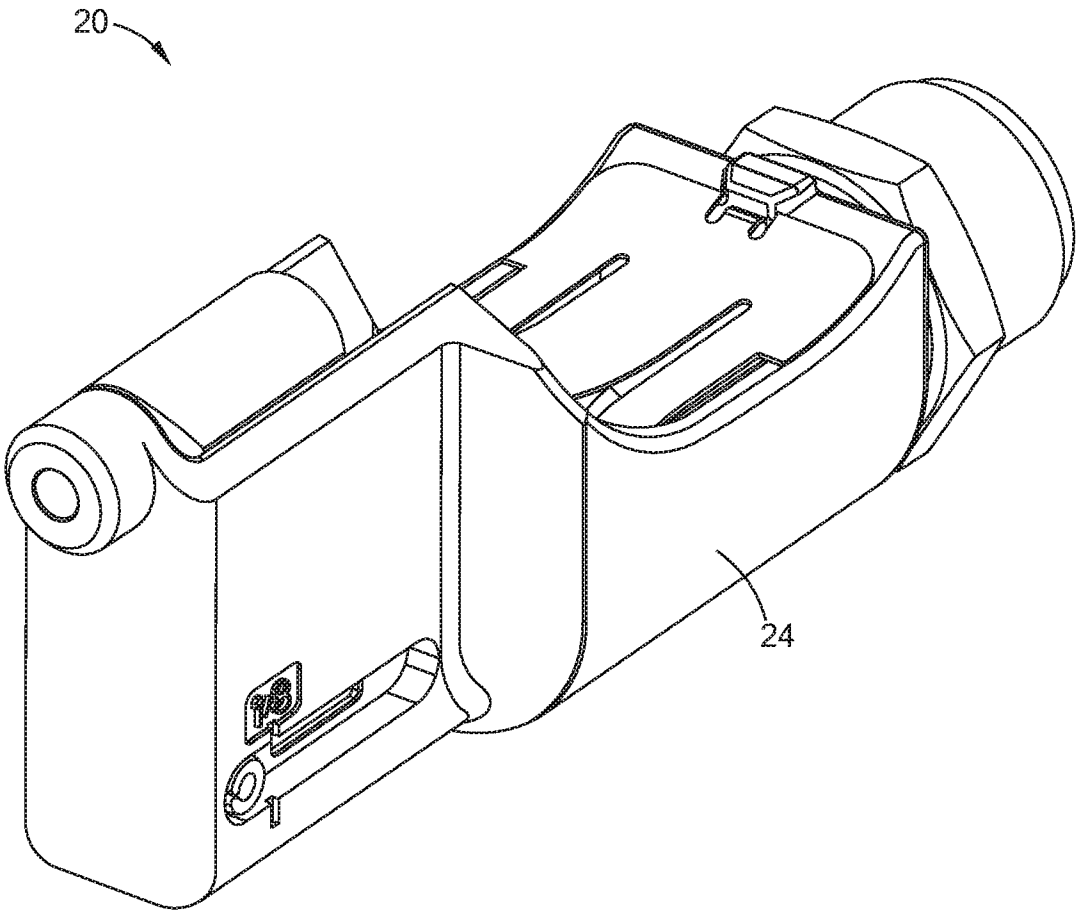
FIG. 1 is a perspective view of a fastener pulling head constructed in accordance with the teachings of the present disclosure.
Figure 2:
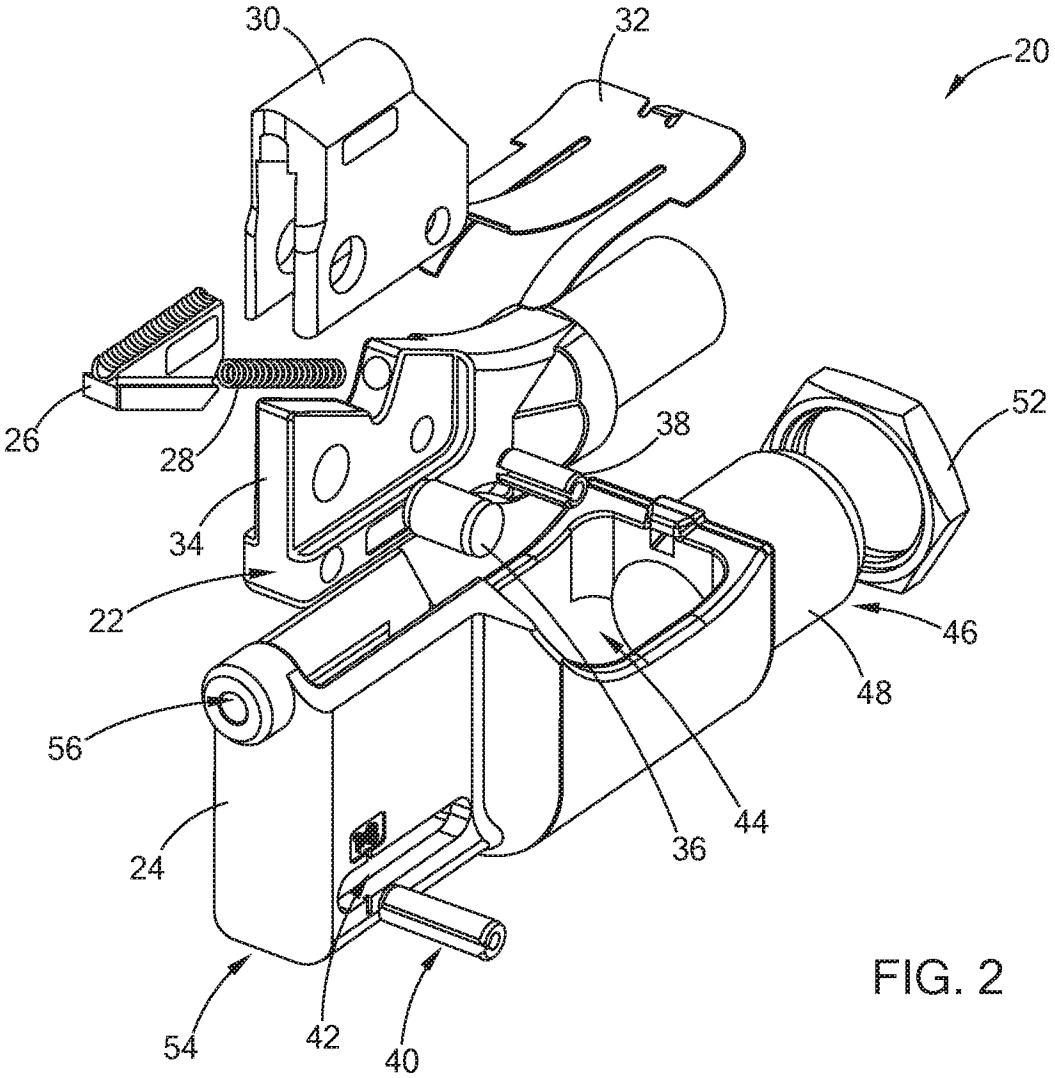
FIG. 2 is an exploded perspective view of the fastener pulling head of FIG. 1 in accordance with the teachings of the present disclosure.

Referring now to FIGS. 1 and 2, a fastener pulling head according to the teaching of the present disclosure is illustrated and generally indicated by reference numeral 20. The fastener pulling head 20 generally comprises a drawbolt assembly 22 disposed within a frame 24, a jaw 26 and spring 28 secured to the drawbolt assembly 22 for engaging and gripping a fastener (described in greater detail below), a saddle 30 to cover and secure the jaw 26 and spring 28 to the drawbolt assembly 22, and a guard 32 for enclosing an otherwise exposed portion of the fastener pulling head 20.

As further shown, the drawbolt assembly 22 includes a drawbolt body 34, and the fastener pulling head 20 further includes both a dowel pin 36 and a roll pin 38 for securing the saddle 30 to the drawbolt body 34, and a second roll pin 40 to facilitate sliding of the drawbolt body 34 relative to the frame 24. The second roll pin 40 also serves to provide a visual indication of grip force through an aperture 42 formed through the frame 24 as shown, which is described in greater detail below.

The frame 24 of the fastener pulling head 20 includes a hollow interior 44 as shown to receive the drawbolt assembly 22 and other components as illustrated and described herein. The frame 24 defines a proximal end portion 46 having an extension 48 with exterior threads for engaging the head of a power tool 12, along with a jam nut 52 for securing the fastener pulling head 20 to the power tool 12. At a distal end portion 54, the fastener pulling head 20 includes an opening 56 for receiving the stem of a fastener (not shown).

Figure 3:
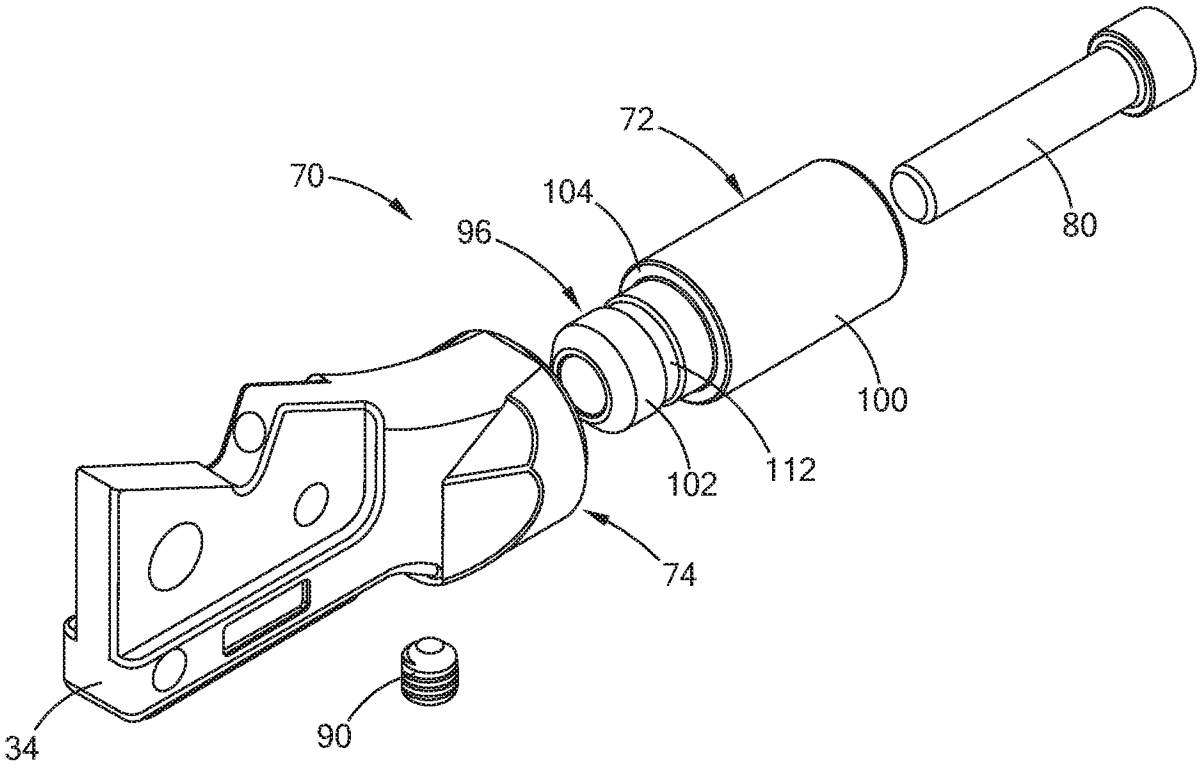
FIG. 3 is an exploded view of an adjustment system, also referred to as a drawbolt assembly, within the fastener pulling head of FIG. 1 constructed in accordance with the teachings of the present disclosure.
Figure 4:
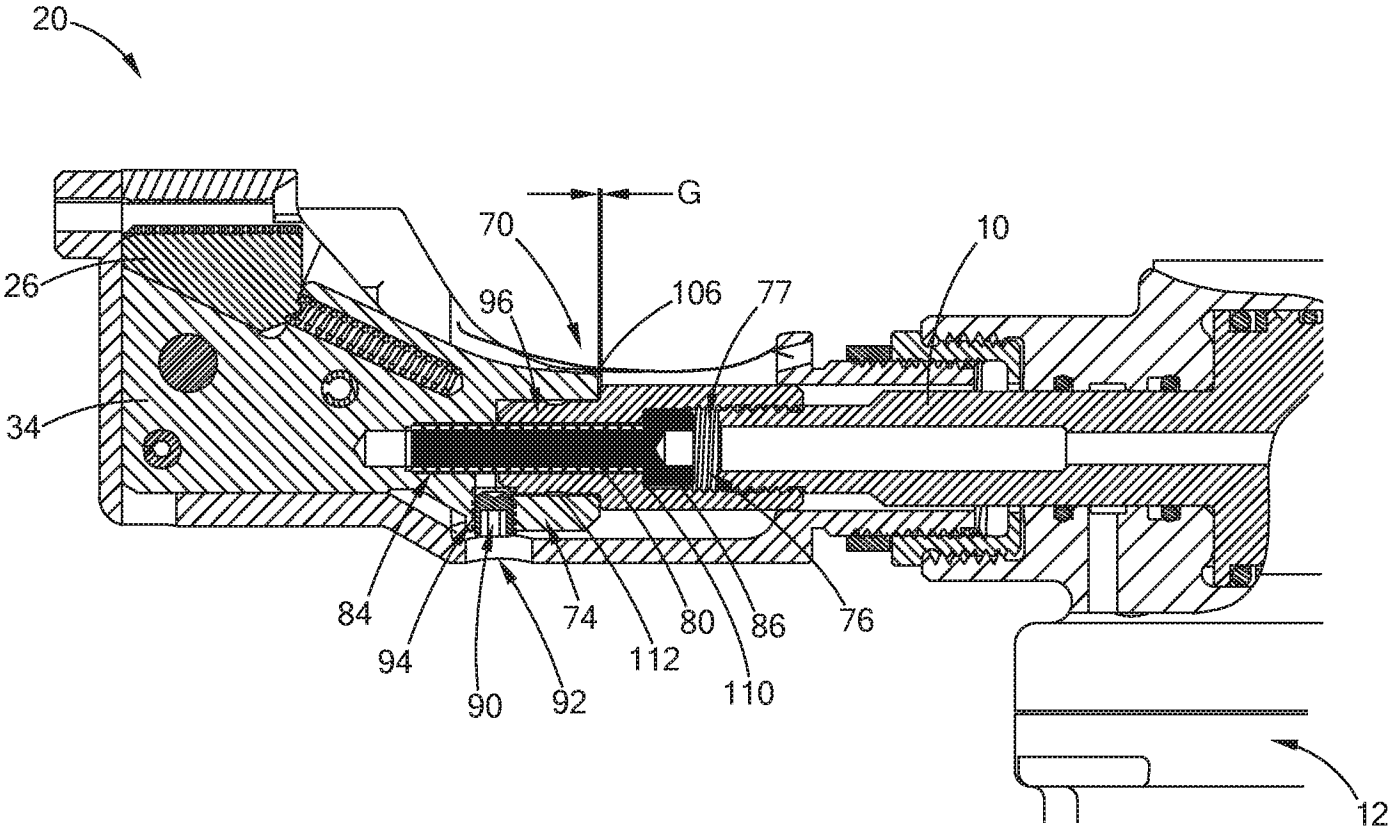
FIG. 4 is a cross-sectional side view of a fastener pulling head and adjustment system in accordance with the teachings of the present disclosure.

Referring now to FIGS. 3 and 4, an adjustment system according to the teachings of the present disclosure is illustrated and generally indicated by reference numeral 70. Generally, the adjustment system 70 is adapted to adjust a gripping force of the jaw 26 and also a rotational position of the fastener pulling head 20. As shown, the adjustment system 70 includes a swivel adapter 72 configured for engagement with a proximal end portion 74 of the drawbolt body 34. The swivel adapter 72 in one form defines an internal bore 76 that receives a cap screw 80. The cap screw 80 defines external threads that engage an internally threaded bore 84 within drawbolt body 34 as shown, thereby longitudinally securing the drawbolt body 34 while the frame 24 is allowed to move as described in greater detail below. A set screw 90 is configured to engage and secure the swivel adapter 72 within the drawbolt body 34. More specifically, the frame 24 includes a lower opening 92 through which the set screw 90 can be accessed, and the drawbolt body 34 includes a threaded recess 94 to receive the set screw 90. The set screw 90 is positioned at a distal end portion 96 of the swivel adapter 72, however, it should be understood that this position is merely exemplary and the set screw 90 may be located at another position along the swivel adapter 72 while remaining within the scope of the present disclosure.

As further shown, the swivel adapter 72 includes a proximal outer surface 100 and a distal outer surface 102, the distal outer surface 102 having a smaller periphery than the proximal outer surface 100 and a shoulder 104 disposed therebetween. The shoulder 104 is configured for close proximity to define a small gap between a proximal end face 106 of the drawbolt body 34 as described in greater detail below. The swivel adapter 72 is this form is cylindrical, however, it should be understood that other geometries and surface textures may be provided while remaining within the scope of the present disclosure.

In one form, the internal bore 76 of the swivel adapter 72 is threaded at a distal end portion to receive the external threads 82 of the cap screw 80. Additionally, the internal bore 76 of the swivel adapter 72 defines a shoulder 110 configured for abutment with a head 86 of the cap screw 80. The swivel adapter 72 further comprises an external bearing surface 112 around its distal outer surface 102, which is configured to receive a lubricant for lubricating an interface between the swivel adapter 72 and the drawbolt body 34. As further shown, a proximal end portion 77 of the swivel adapter 72 is threaded to receive a piston 10 of the power tool 12.

Figure 5A:
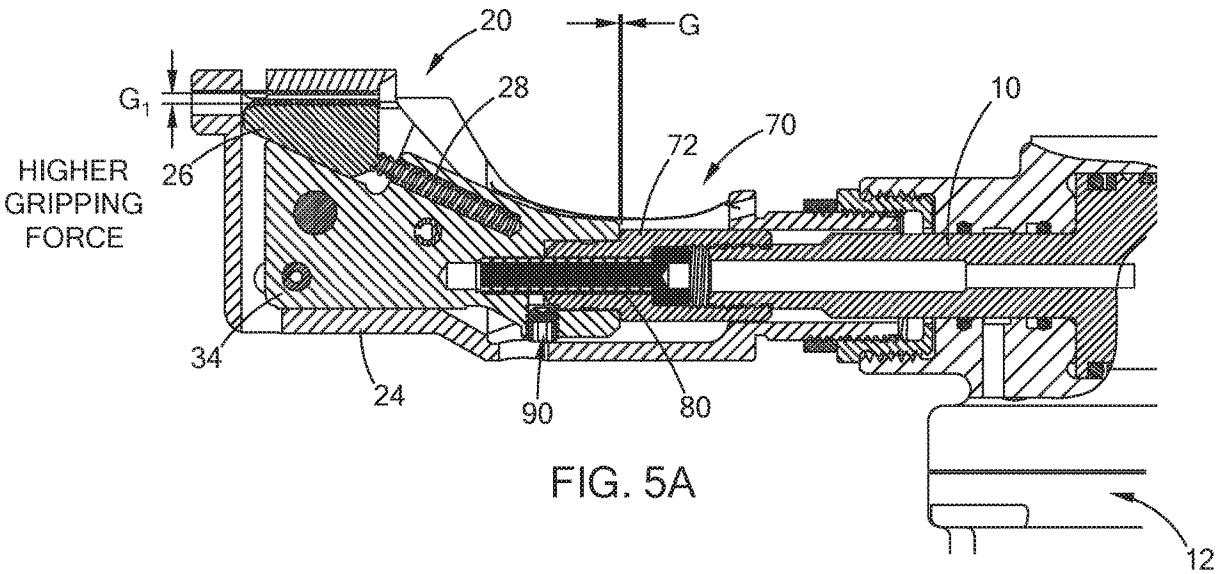
FIG. 5A is a cross-sectional view illustrating the adjustment system and the fastener pulling head rotated to a position with a higher gripping force in accordance with the teachings of the present disclosure.
Figure 5B:
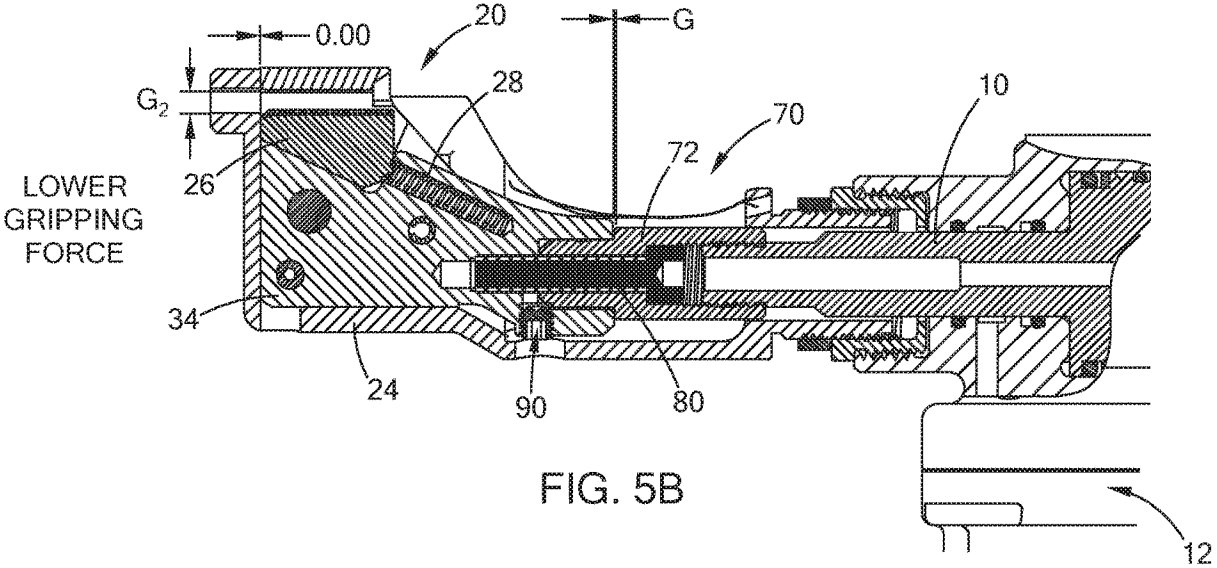
FIG. 5B is a cross-sectional view illustrating the adjustment system and the fastener pulling head rotated to a position with a lower gripping force in accordance with the teachings of the present disclosure.
Figure 6:
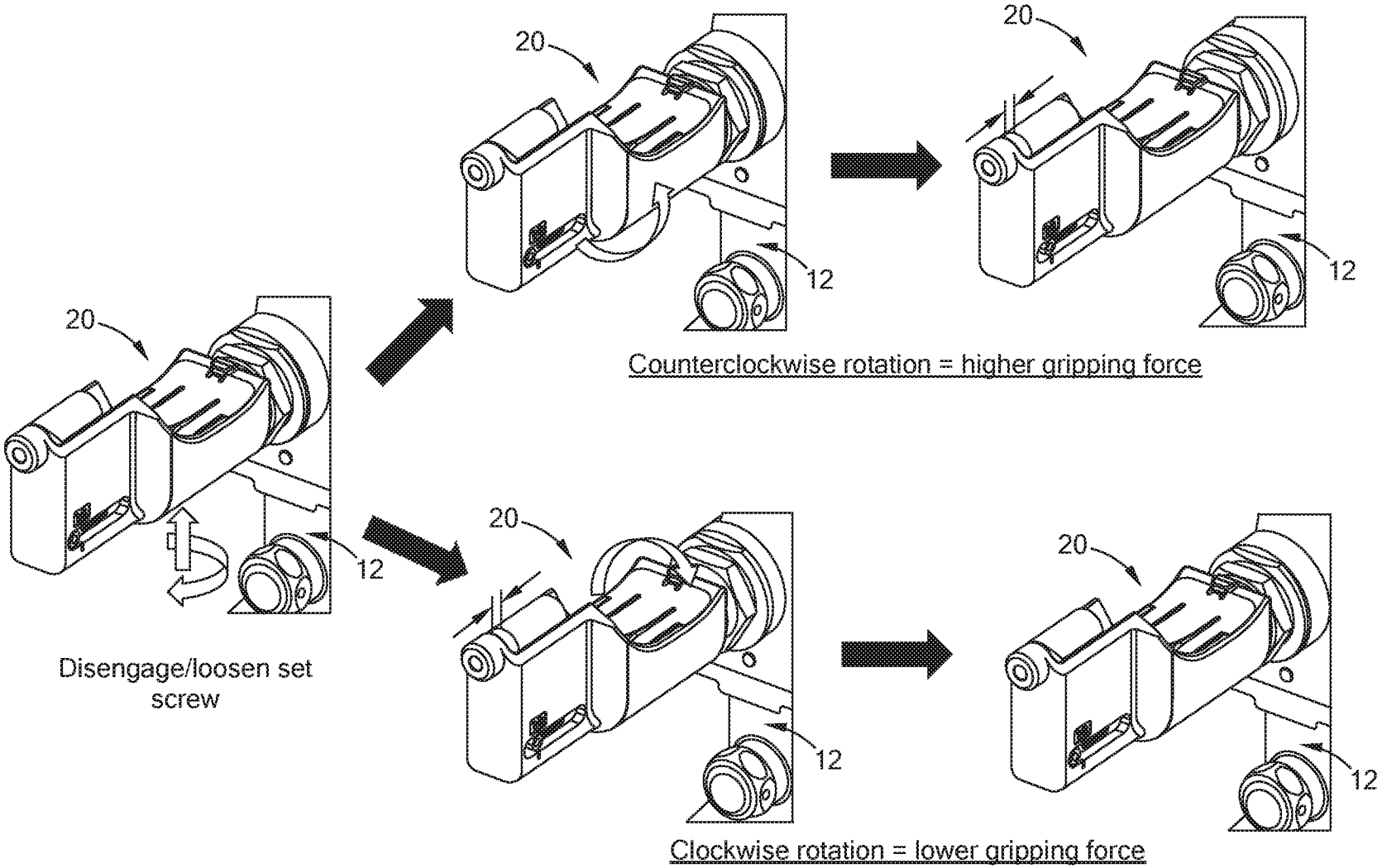
FIG. 6 is a flow diagram illustrating a method of adjusting a fastener pulling head and its gripping force in accordance with the teachings of the present disclosure.

Referring to FIGS. 5A and 5B, generally, the adjustment system 70 allows the drawbolt body 34 to rotate relative to the swivel adapter 72 without impacting its engagement with the piston 10 of the power tool 12, which causes the jaw 26 to open and close, thereby adjusting the jaw gripping force. First, the cap screw 80 is not quite tightened, such as to allow rotational freedom of the swivel adapter 72 relative to the drawbolt body 34. In one form, a slight gap "G" is provided as shown to nominally allow one degree of freedom (rotation), of the swivel adapter 72 relative to the drawbolt body 34. In order to install the fastener pulling head 20 to the power tool 12, the set screw 90 is be tightened securely. Once the fastener pulling head 20 is installed on the power tool 12, the set screw 90 is disengaged from the swivel adapter 72 by loosening, and the set screw 90 remains disengaged during operation of the fastener pulling head 20. As long as the set screw 90 is disengaged the fastener pulling head 20 can be rotated relative to the swivel adapter 72, which causes the frame 24 to move axially relative to the drawbolt body 34 to adjust the jaw gripping force. More specifically, and also with reference to FIG. 6, when the fastener pulling head 20 is rotated counterclockwise, the frame 24 threads out of the head of a power tool 12, moving away relative to the drawbolt body 34, by virtue of the swivel adapter 72 rotating around the cap screw 80, creating a gap ahead of the drawbolt body 34 which allows the jaw 26, which is slidably engaged on an inclined surface with the drawbolt body 34 as shown, to be pushed forward by the spring 28, effectively moving up and thus increasing the jaw gripping force by creating a smaller gap $G_1$ as shown. Conversely, when the fastener pulling head 20 is rotated clockwise, the frame 24 threads into the head of the power tool 12 moving towards the drawbolt body 34 and reducing the gap ahead of it, pushing the jaw 26 towards spring 28 on an inclined surface, causing it to effectively move down, thereby decreasing the jaw gripping force with the larger gap $G_2$. The set screw 90 remains disengaged as long as the fastener pulling head 20 is installed onto the power tool 12 and is only tightened when the pulling head 20 is to be removed from the power tool 12.

In this form as shown, about three 360° rotations of the pulling head 20 provide a full range of maximum and minimum gripping force (about 0.150" of adjustment). To accomplish this range, the frame 24 is threadably engaged into the head of the power tool 12 having a thread pitch of 0.050". It is to be expected that different power tools will have different thread configurations, affecting how many rotations are necessary for complete adjustment, and thus this form is merely exemplary and should not be construed as limiting the scope of the present disclosure. Additionally, the adjustment system 70 facilitates positioning of the fastener pulling head 20 at any angle throughout this 360° position without disengaging the swivel adapter 72 from the piston 10 of the power tool 12. The user simply loosens the jam nut 52, rotates the fastener pulling head 20 to the desired angle, and then tightens the jam nut 52 to lock the fastener pulling head 20 in position. Although this rotation will cause movement of the jaw 26, the small angular adjustment will have a negligible impact on the jaw gripping force It should be understood that the set screw 90 is but one of any number of retention members that can be configured to engage and secure the swivel adapter 72 within the drawbolt body 34. For example, other retention members may include but are not limited to a dowel pin, a screw or set screw on the same axis with the cap screw 80 and accessed through an opening (not shown) from the distal end of the fastener pulling head 20. Additionally, the cap screw 80 is also only one of any number of adjustment members disposed within the internal bore 76 of the swivel adapter 72 and configured to engage the drawbolt body 34.

Figure 7A:
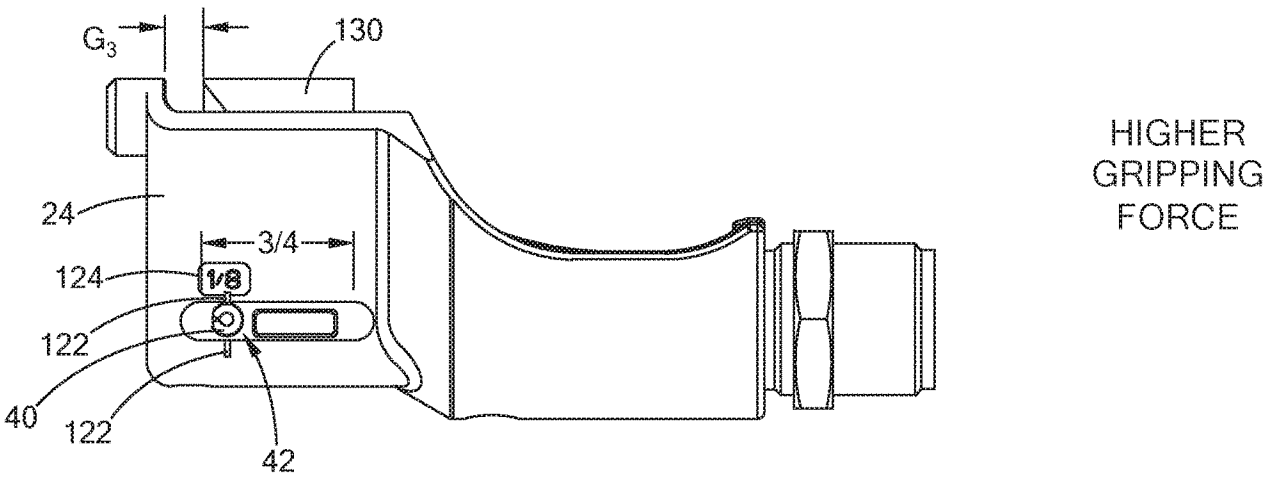
FIG. 7A is a side view illustrating an aperture and marking for indicating a proper grip force for a specific fastener size in accordance with the teachings of the present disclosure.
Figure 7B:
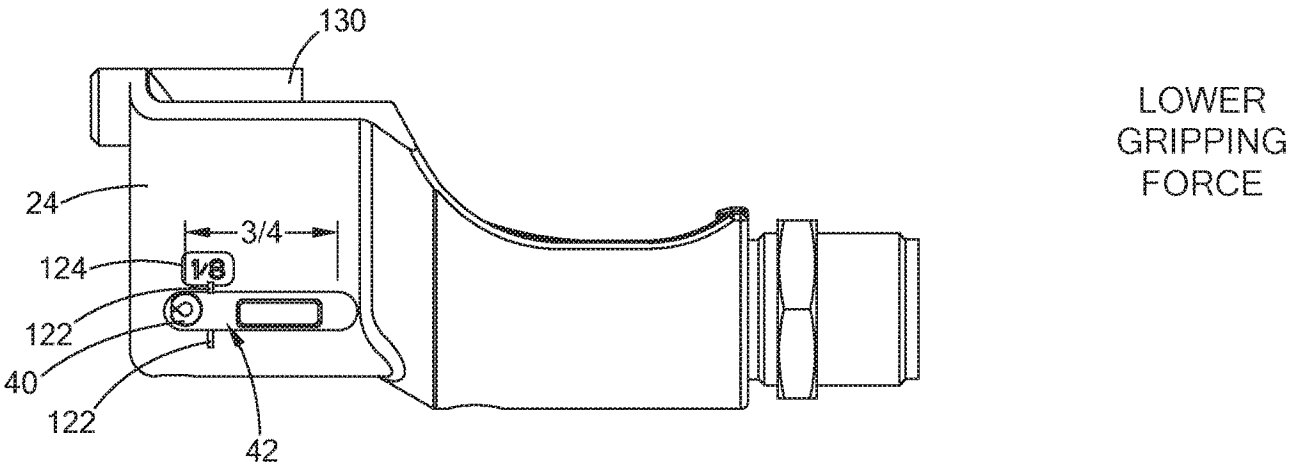
FIG. 7B is another side view illustrating the aperture and marking for indicating a grip force in accordance with the teachings of the present disclosure.

Referring to FIGS. 7A and 7B, the visual indication of grip force is now described in greater detail. As shown, the aperture 42 includes at least one marking disposed along its side, which in this form includes opposed hash marks 122 and a ⅛" fastener indication 124. During jaw grip adjustment, as the frame 24 moves away from the drawbolt body 34, the second roll pin 40 moves relative the aperture 42. The position of the second roll pin 40 relative to the marking along the aperture 42 indicates an amount of grip force. In FIG. 7A, the position of the second roll pin 40 indicates the higher gripping force, and in this exemplary form, the proper grip force for a ⅛" diameter fastener, (or a "−4" fastener as it is commonly referred to in the art). In FIG. 7B, the position of the second roll pin 40 indicates the lower gripping force, where the jaw 26 is fully open for number 5 and 6 diameters. It should be noted that any adjustment between these two limits may be chosen for proper operation of the pulling head 20; for example, as the jaw wears out or gets clogged, a slightly higher grip adjustment will increase the life of the pulling head 20 before the jaw 26 must be replaced. Also note the position of a saddle drawbar 130 all the way forward for this lower gripping force, whereas the saddle drawbar 130 is positioned with a gap $G_3$ as the frame 24 is moved away to achieve a higher gripping force.

It should be understood that other types of markings and indications, including haptic indications, may be employed while remaining within the scope of the present disclosure. Accordingly, the opposed hash marks 122 and ⅛" fastener markings 124 should not be construed as limiting the scope of the present disclosure.

Referring now to FIGS. 8A through 8F, various rotational positions of the pulling head 20 are illustrated, along with the corresponding position of the jaw 26 and its gripping force, and the position of the frame 24 relative to the power tool 12. FIG. 8A illustrates the jaw 26 being fully closed, FIG. 8B shows a +45° rotation of the pulling head 20 where the frame 24 moves away from the drawbolt body 34 and movement of the jaw 26 is negligible, FIG. 8C shows a −45° rotation of the pulling head 20 where the frame 24 moves towards the drawbolt body 34, and then FIGS. 8D and 8E show a progressive 90° and 135° rotation, respectively. Finally, FIG. 8F shows the jaw 26 fully open.

As shown in FIG. 9, the fastener pulling head 20 and its adjustment system 70 according to the present disclosure is more compact than existing designs in the prior art, thus providing improved access, for example in tighter work areas, for the user. Additionally, the adjustment system 70 provides a lighter weight design and increases user productivity with its dual adjustment feature. The adjustment system 70 can also provide longer tool life and is more versatile over the prior art due to the ability to accommodate different fastener types and grip lengths due to a longer stroke/jaw gripping capability. Moreover, the adjustment system 70 can be employed with any type of pulling head and is not limited to the offset style as illustrated herein. For example, the adjustment system 70 can be used with right-angle pulling heads (for example, the Cherry® H753 and H828 pulling heads), alternate styles of offset pulling heads (for example, the Cherry® H782 pulling head), and straight pulling heads, among others.

Additionally, a position of the pulling head 20 may also be adjusted through the adjustment system 70 without impacting the engagement of the fastener pulling head 20 with the power tool piston 10, therefore protecting the power tool 12 from damage due to reduced piston thread engagement.

The description of the disclosure is merely exemplary in nature and, thus, variations that do not depart from the substance of the disclosure are intended to be within the scope of the disclosure. Such variations are not to be regarded as a departure from the spirit and scope of the disclosure.

As used herein, the phrase at least one of A, B, and C should be construed to mean a logical (A OR B OR C), using a non-exclusive logical OR, and should not be construed to mean "at least one of A, at least one of B, and at least one of C.

What is claimed is:

1. An adjustment system for a blind fastener pulling head that includes a frame, a jaw, and a drawbolt body, the adjustment system comprising:

a swivel adapter configured for engagement with a proximal end portion of the drawbolt body of the pulling head, the swivel adapter defining an internal bore;

an adjustment member disposed within the internal bore of the swivel adapter and configured to engage the drawbolt body; and a retention member configured to move between an engaged position and a disengaged position, wherein when in the engaged position, the retention member is engaged to the swivel adapter within the drawbolt body and secures the swivel adapter, and when the retention member is in the disengaged position, the retention member is disengaged from the swivel adapter to permit the pulling head to be rotated to cause the frame to move relative to the drawbolt body and adjust a gripping force of the jaw.

2. The adjustment system according to claim 1, wherein the swivel adapter defines a proximal outer surface and a distal outer surface, the distal outer surface having a smaller periphery than the proximal outer surface and a shoulder disposed therebetween.

3. The adjustment system according to claim 2, wherein the swivel adapter defines a cylindrical geometry along the proximal outer surface and the distal outer surface.

4. The adjustment system according to claim 1, wherein the internal bore of the swivel adapter defines threads and the adjustment member includes external threads configured to threadably engage the threads of the internal bore.

5. The adjustment system according to claim 4, wherein the internal bore of the swivel adapter defines a shoulder configured for abutment with a head of the adjustment member.

6. The adjustment system according to claim 1, wherein the swivel adapter further comprises an external bearing surface configured to receive a lubricant for lubricating an interface between the swivel adapter and the drawbolt body.

7. The adjustment system according to claim 1, wherein the adjustment member is a cap screw.

8. The adjustment system according to claim 1, wherein the retention member is a set screw.

9. An adjustment system for a fastener pulling head that includes a frame, a jaw, and a drawbolt body, the adjustment system comprising:

a swivel adapter configured for engagement with a proximal end portion of the drawbolt body of the pulling head, the swivel adapter defining an internal bore;

an adjustment member disposed within the internal bore of the swivel adapter and configured to engage the drawbolt body; and a retention member configured to engage and secure the swivel adapter at a location within the drawbolt body, wherein when the retention member is disengaged from the swivel adapter, the pulling head can be rotated to cause the frame to move relative to the drawbolt body to adjust a gripping force of the jaw.

10. The adjustment system according to claim 9, wherein the adjustment member is a screw that threadably engages the drawbolt body.

11. The adjustment system according to claim 10, wherein the internal bore of the swivel adapter defines a shoulder configured for abutment with a head of the adjustment member.

12. The adjustment system according to claim 9, wherein the retention member is a set screw.

13. The adjustment system according to claim 9, wherein the swivel adapter defines a proximal outer surface and a distal outer surface, the distal outer surface having a smaller periphery than the proximal outer surface and a shoulder disposed therebetween.

14. The adjustment system according to claim 13, wherein the swivel adapter defines a cylindrical geometry along the proximal outer surface and the distal outer surface.

15. The adjustment system according to claim 9, wherein the swivel adapter further comprises an external bearing surface configured to receive a lubricant for lubricating an interface between the swivel adapter and the drawbolt body.

16. A method of adjusting a jaw gripping force and position of a fastener pulling head comprising the steps of:

a) providing a tool having a piston and a pulling head;

b) engaging a retention member of the pulling head to install the pulling head to the tool;

c) installing the pulling head onto the piston of the tool;

d) disengaging the retention member;

e) unlocking a jam nut to allow rotation of the pulling head;

f) rotating the pulling head to a desired position, thereby causing an adjustment system to move a frame relative to a drawbolt assembly disposed within the pulling head; and g) tightening the jam nut upon reaching the desired position.

17. The method according to claim 16, wherein steps a) through d) are performed to adjust a position of the fastener pulling head.

18. The method according to claim 16, wherein the jaw gripping force is increased by rotating the pulling head counterclockwise.

19. The method according to claim 16, wherein the jaw gripping force is decreased by rotating the pulling head clockwise.

20. The method according to claim 16 further comprising observing a position of a roll pin within an aperture and relative to a marking to determine a proper gripping force for a predetermined fastener size.

* * * * *